United States Patent [19]

Lucero et al.

[11] 4,238,127

[45] Dec. 9, 1980

[54] ELECTRONIC GAMING APPARATUS

[75] Inventors: Andres R. Lucero; Neil J. Netley; Richard C. Raven, all of Reno; Chester C. Egan, Jr., Sparks, all of Nev.

[73] Assignee: Bally Manufacturing Corporation, Chicago, Ill.

[21] Appl. No.: 759,809

[22] Filed: Jan. 17, 1977

[51] Int. Cl.[3] ..... A63F 9/00

[52] U.S. Cl. ..... 273/143 R; 197/102; 273/138 A

[58] Field of Search ..... 273/1 E, 85 R, 138 A, 273/139, 143 R, 143 C; 133/1 R, 2 R, 3 R; 197/97 R, 102; 235/92 CN

[56] References Cited

U.S. PATENT DOCUMENTS

| | | | |
|---|---|---|---|
| 2,998,252 | 8/1961 | Martin | 273/143 R |
| 3,606,337 | 9/1971 | Larsen et al. | 273/143 R |
| 3,642,287 | 2/1972 | Lally et al. | 273/143 R |
| 3,733,075 | 5/1973 | Hooker et al. | 273/143 R |
| 3,876,208 | 4/1975 | Wachtler et al. | 273/138 A |
| 3,916,922 | 11/1975 | Prümm | 133/3 R |
| 3,929,338 | 12/1975 | Busch | 273/138 A |
| 4,095,795 | 6/1978 | Saxton et al. | 273/138 X |
| 4,099,722 | 7/1978 | Rodesch et al. | 273/138 A |

FOREIGN PATENT DOCUMENTS

| | | | |
|---|---|---|---|
| 41594 | 2/1971 | Australia | 273/138 A |
| 2016481 | 10/1971 | Fed. Rep. of Germany | 273/143 R |
| 1430007 | 3/1976 | United Kingdom | 273/138 A |

*Primary Examiner*—Vance Y. Hum

*Attorney, Agent, or Firm*—Fitch, Even, Tobin, Flannery & Welsh

[57] ABSTRACT

In amusement and game apparatus of the type having a set of symbol-bearing reels and mechanism for spinning the reels after depositing the proper coins, an electronic control for selecting the stopping positions for the reels, for detection of the reel position, for calculating the payout to the player in response to the reel position, and for monitoring the payout and resetting the device for the next play.

10 Claims, 9 Drawing Figures

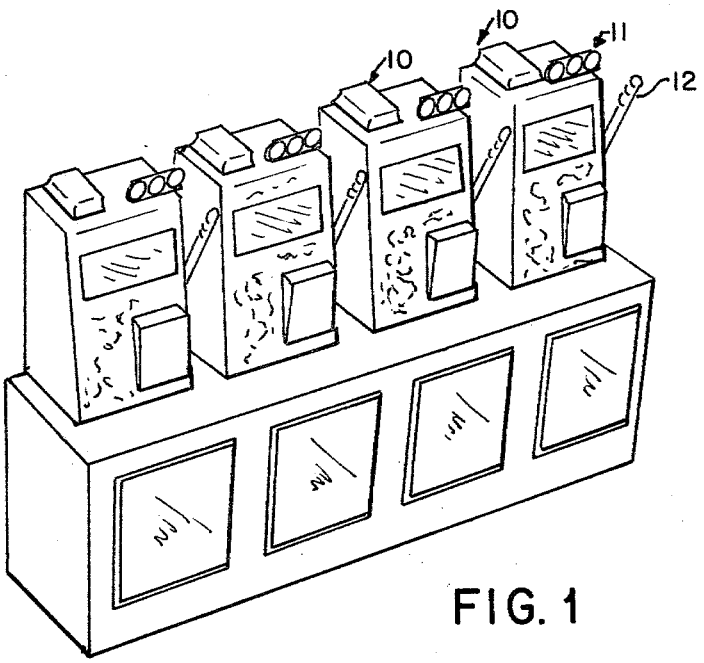
FIG. 1
FIG. 2
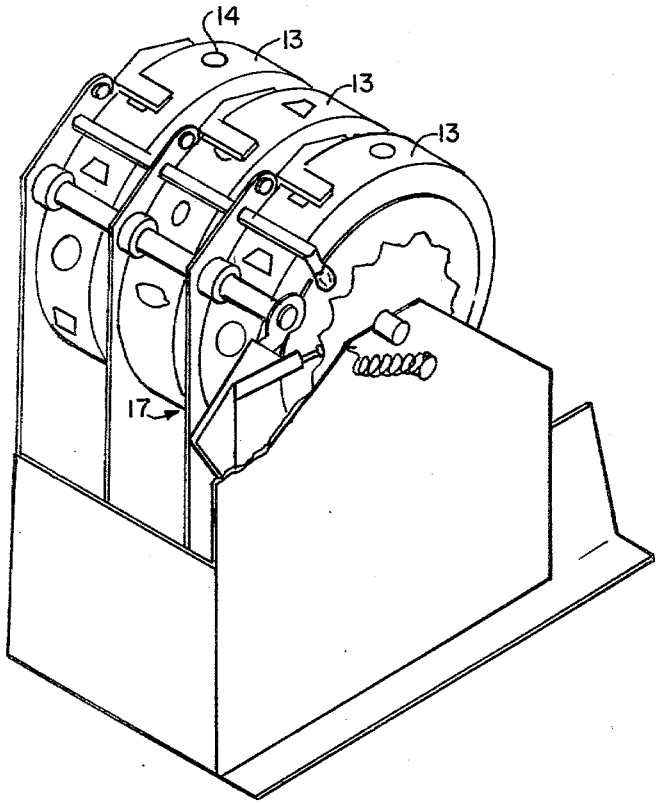

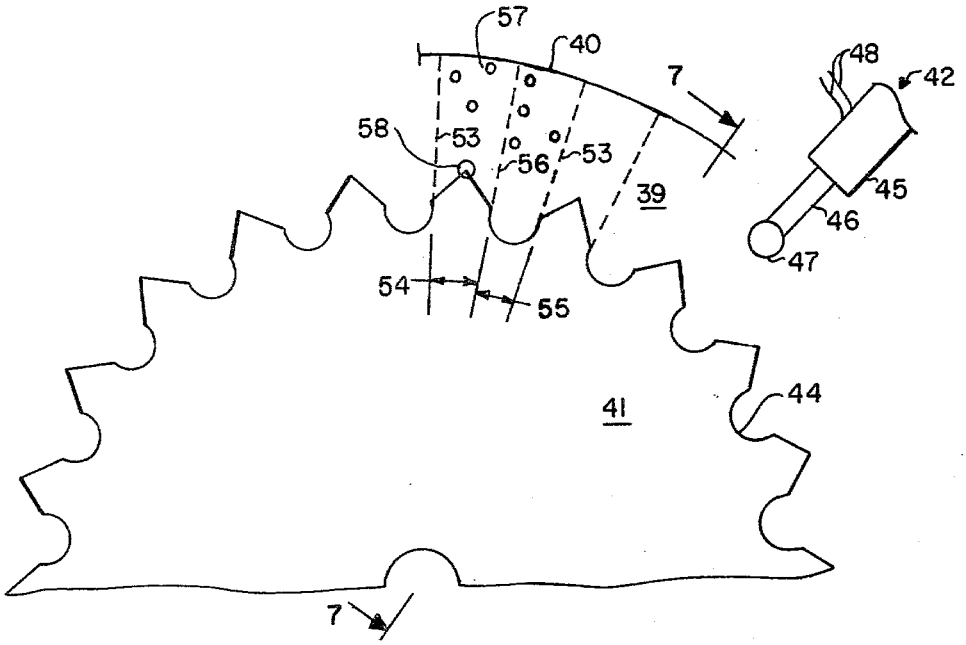
FIG. 6
FIG. 7
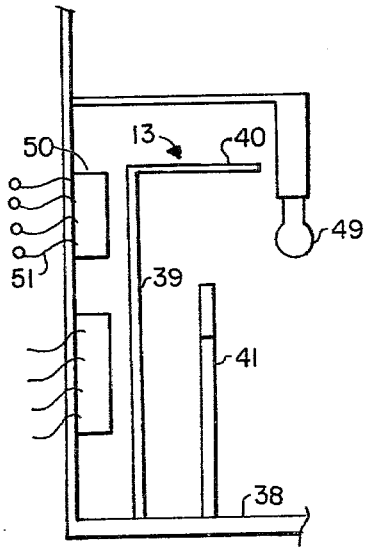

ELECTRONIC GAMING APPARATUS

BACKGROUND OF THE INVENTION

The subject invention is applicable to many types of gaming devices wherein the player inserts the proper coin or coins and activates a plurality of movable members. These members are subsequently stopped in random positions with a payout being made in response to the degree of correlation between the stopped positions and predetermined winning combinations. While the invention has broader application, it is described herein for use in a gaming device commonly known as a slot machine having internal mechanical operating mechanisms similar to that described in U.S. Pat. No. 3,642,287, Rotating Reel Game With Masking Shutter, issued on Feb. 15, 1972, with Lally et al, inventors.

In the device of that patent and other similar devices relating to permutation and combination apparatus, there is provided a plurality of symbol-bearing reels mounted for rotation about a single axis. The reels are set into rotation by the player pulling a handle. Thereafter a timing apparatus stops the reels individually and on a random basis.

Located on the outer periphery of the reels are combinations of indicia visible to the player. When the reels have all stopped, there is viewed by the player the combinations of indicia written on the outer periphery of the reels which combinations determine whether or not a payoff will be received by the player. At the same time the stopped positions of the reels are sensed and fed to a calculator which activates a payout sequence if the combinations correspond to those selected for payout.

Since the winning combinations are determined by the positions in which the reels come to rest, the payout percentages for the machine are dependent upon the proper operation of the reel mechanism. Because the reel mechanism is a mechanical device, it is subject to abnormalities in operation due to, among other things, reel imbalance, reel friction and reel wear. Such inconsistencies in operation result in the unpredictability of the payout percentages which is disadvantageous both to the player and to the machine owner. It is the primary object of this invention to provide a mechanical gaming device having an electronic control with associated sensing means for operating the game such that inaccuracies in operation due to mechanical malfunctions are minimized and the predictability of correct and reliable operation of the machine is greatly enhanced.

SUMMARY OF THE INVENTION

In a gaming mechanism of the type having mechanical mechanisms which are put into motion and the winning combinations are determined by the stopped position thereof, the combination of a random number generator which is set into operation when the game is initiated, means to detect the number generated by the random number generator and for stopping the movable members at positions corresponding to those numbers, and means for sensing the stopped position of the movable members for generating a signal for use in calculating the payout to the player.

DESCRIPTION OF THE DRAWINGS

FIG. 1 is a perspective view of a prior art gaming device of a type to which the subject invention can be applied;

FIG. 2 is a perspective view of a reel mechanism of a gaming device incorporating the subject invention;

FIG. 6 is an enlarged side view of the reel and reel stopping mechanism of the subject invention;

FIG. 7 is a cross-sectional view along the line 7—7 of FIG. 6;

DESCRIPTION OF THE INVENTION

Figure 3:
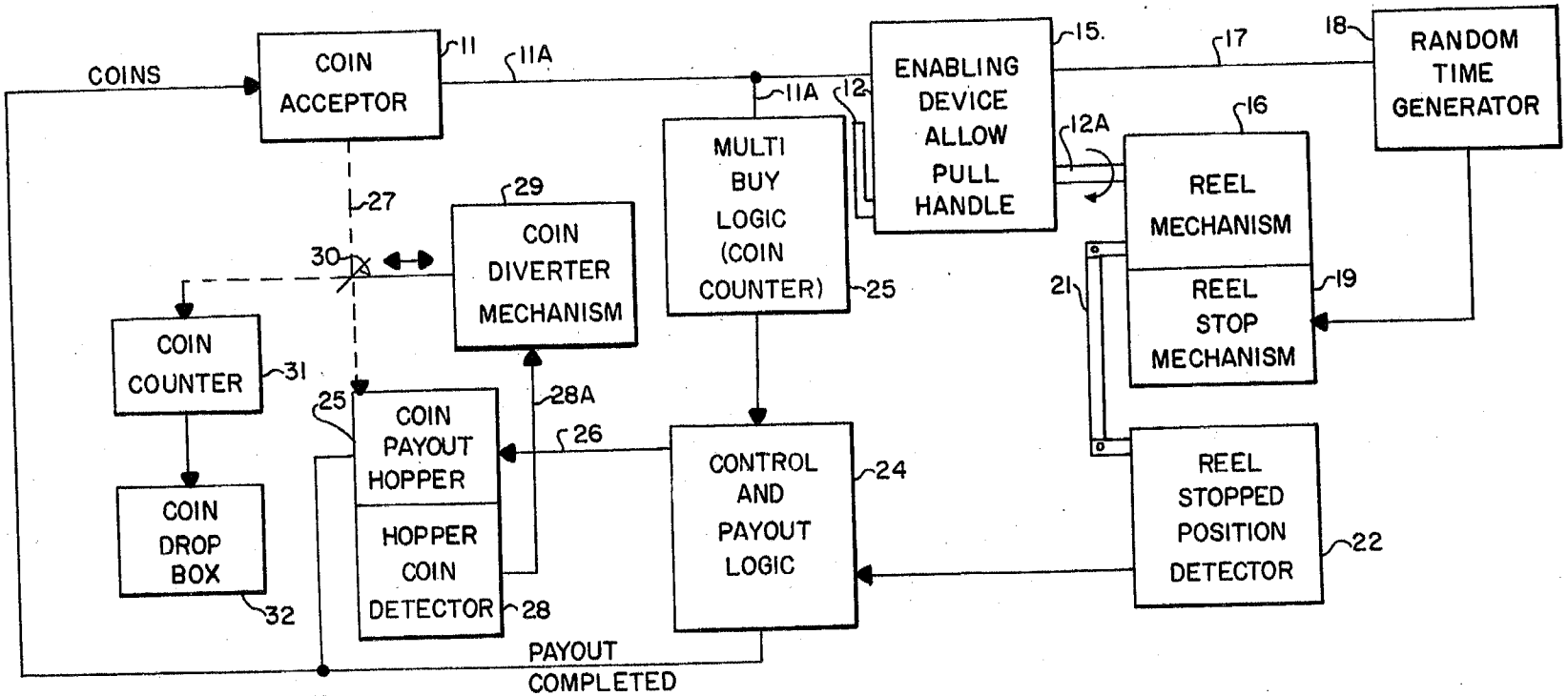
FIG. 3 PRIOR ART
FIG. 3 is a block diagram showing the functioning of a typical prior art gaming device.

In FIG. 1 is shown a typical prior art machine in which the subject invention can be incorporated. Each gaming machine 10 is activated by placing coins into a coin acceptor 11 such as that disclosed in U.S. Pat. No. 3,998,309, Mandes et al, Coin Accepting Device, issued Dec. 21, 1976, and assigned to the same assignee as this invention. Generally such coin acceptors conduct various tests concerning size, weight and metallic content of the offered coin, for identifying the individual coins as being acceptable for playing the gaming machine. Frequently in such devices multiple coins can be paid in succession to multiply the payout and also to increase the odds of winning.

If the coins are accepted, display lights (not shown) are lit to indicate the machine is enabled for playing. Play is initiated by pulling the handle 12 which sets into rotation a plurality of reels 13 (FIG. 2) which are subsequently stopped making visible the combinations of indicia 14 on each reel outer periphery. Payouts are determined by whether or not the indicia on the stopped reels compare with predetermined winning combinations.

In FIG. 3 is shown a functional block diagram of a typical prior art gaming machine. Therein the coin acceptor 11 is shown as receiving the coins. The receipt of the coins and the activation of the device for play is indicated through the control line 11A by a proper signal to the enabling device 15 permitting the player to pull the handle 12 of the device. The handle motion is transmitted through the mechanical linkage 12A to set the reel mechanism 16 in motion. At the same time the enabling device through the control line 17 sets into motion a mechanical random time generator 18 which activates a reel stop mechanism 19 for stopping the individual reels in succession. Generally such reel mechanisms comprise three or more individual reels.

The random time generator 18 has usually been a mechanical device which on a random time basis, actuates suitable linkages to stop the reels in successive order and at random locations. Thereafter through the control linkage 21 the reel stopped position detector 22 detects the position of each reel and feeds a suitable signal to the control and payout logic 24 for calculation of any payout. In one embodiment, the stopped position detector is a mechanical linkage which positions electrical slide contacts (not shown) indicating the reel position. Prior to this time and through the conductor 11A, there has been supplied by a coin counter 25 a signal indicative of the number of coins played in the machine to enable the control 24 to calculate the payout. Thereafter by proper actuation of a coin payout hopper 25 a predetermined number of coins are disbursed in accordance with a signal supplied through the control line 26.

The coins in the payout hopper pass from the coin acceptor 11 along the path 27. The total weight of the coins in the hopper is detected by the hopper coins detector 28 which, when the weight is above a predetermined value, actuates a coin diverter mechanism 29 through the conductor 28A to move a deflector 30 into the path of the coins and divert any further coins received through a coin counter 31 to a coin drop box 32. More complete details of a typical gaming device of the type just described can be obtained by reference to the heretofore-identified U.S. Pat. No. 3,642,287.

Thus the reel stopping positions are determined or affected to some degree by the mechanical condition of the reel mechanism, that is, the freedom with which the reels turn, since it is obvious that if a reel failed to turn with the actuation of the lever, the player would immediately recognize that his odds could be greatly enhanced or greatly reduced depending upon whether winning or losing indicia was displayed on the stalled reel.

In addition, the payout hopper gross weight is detected by the typical hopper coin detector 28 and the diverter mechanism 29 actuated in the present machines during the period of insertion of the coins. Past experience has shown that the hopper coin detectors function as weight detectors and tend to oscillate or chatter when the critical weight is approached to thereby render a lack of control on the count of the coins because the coin might pass to the hopper or drop box depending upon the immediate momentary position of the oscillating diverter. Thus coin accountability is very difficult in the present machines thereby requiring that the owners depend only upon a gross count of coins taken from the repositories and not upon a precise count of coins played in each machine indicating the gross number of coins deposited in the payout hopper and the drop box. The payout hopper of course is maintained full to accommodate payout requirements while the drop box serves as a repository for coins received in excess of the payout hopper capacity. The drop box coins are collected periodically by the machine owner.

In accordance with one feature of the invention, there is provided electronic means for generating the addresses at which the reels are to be stopped, in combination with means for stopping the reels at those respective positions to substantially eliminate the effect of any mechanical malfunctioning of the reels and reel assembly on the selection of the stopping position. This aspect of the invention is illustrated in FIG. 4 wherein components of similar operation and functioning are identified with similar numbers as those in FIG. 3.

Figure 4:
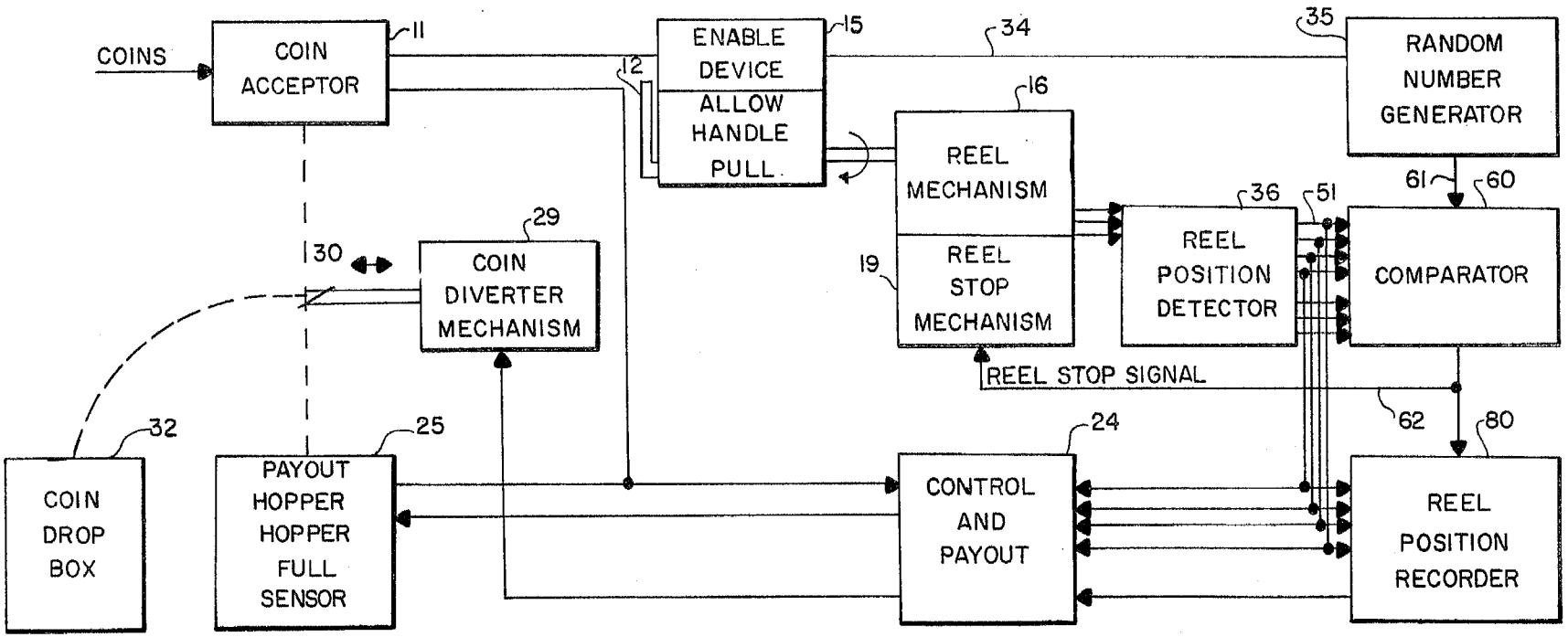
FIG. 4 is a block diagram showing one preferred embodiment of the invention.

Thus shown in FIG. 4 is a coin acceptor 11, an enabling device 15 and a reel mechanism 16. Coins received by the coin acceptor drop either into a payout hopper 25 or a coin drop box 32. A coin diverter mechanism 29 positions a deflector 30 to determine the drop path of the coin.

The enabling device 15 is connected by the conductor 34 to a random number generator 35. The enabling device functions to close a switch in the same manner as it closes switches for activating the control logic and also for lighting the various displays (not shown) to activate the random number generator. In one embodiment of the invention, this random number generator functions continuously at a generating speed of approximately 100 numbers per second on the average. It operates on an algorithm such that the probability of repeating itself theoretically is extremely small. The generator is set to generate a random number corresponding to each address position or each separate indicia on the reel which in this embodiment is approximately 22 index stop positions. Such random number generators are well-known in the electronics art and need not be of special design. It is the random number generated which determines the stopped position for each reel.

For proper stopping of the reel, the instantaneous positions of the reel are detected and for that purpose there is provided a reel position detector 36. One embodiment of a suitable reel position detector is illustrated in FIGS. 6 and 7. Therein is shown a section of an individual reel 13, which rotates about an axis or center shaft 38. The reel generally comprises a flange portion 39 extending from the rim to the center shaft with a peripherally extending cylindrical section 40 carrying the indicia which is read by the player. Rotating with each reel is a selector disc 41 which cooperates with a stopping mechanism 42 to stop the reel at any one of the 22 address positions. The selector disc includes one trigger slot 44 for each address position. The stopping mechanism includes a solenoid 45 which actuates a linkage 46 carrying a bar 47 sized to fit within the trigger slot. Thus by energizing the solenoid through the leads 48, the bar 47 is driven into one of the trigger slots to stop rotation of the selector disc and the associated reel.

The reel position detector 36 comprises a light source or lamp 49 positioned to one side of the reel flange 39 with an array of photo detectors 50 positioned in alignment with and on the opposite side of the reel from the light source. Each photo sensor is connected by a conductor 51.

Referring to FIG. 6, each of the 22 sectors outlined by the dotted lines 53 of the reel is divided into an address section 54 and a decode section 55 separated by the dotted lines 56. The address and decode information takes the form of precisely positioned holes, translucent areas or light transmitting areas 57 in the disc flange with the number, positioning and relative location of these holes being different for each address.

There is positioned in the photo sensor array 50 a sensor (not shown) in alignment with each area in which a hole can be located in the reel flange for coding purposes. Thus as the address area 54 comes into alignment with the photo sensor array 50 a series of signals is transmitted through the conductor connecting with each photo sensor in alignment with a hole and thereby receiving light from the source 49. A different voltage level or signal exists in those conductors connecting with photo sensors not in alignment with a hole. Thus there is provided a composite electrical signal corresponding with the address detected and therefore, with the signal position of the reel.

In alignment with each address area is a timing slot 58. With the alignment of this timing slot with a specific photo sensor in the array provided to detect this slot, a signal is transmitted indicating direct alignment of the address coding with the photo sensor array and thereby indicating that the array should be read at that time. Otherwise if read at a different time the address area might merely be in half alignment with the photo sensor array and erroneous reading would result.

Turning now to FIG. 4, the signal from array 51 is transmitted to a comparator 60. Also the comparator receives through the conductor 61 a signal indicating the random number generated by the generator 35. The comparator can be of any standard design which receives a plurality of signals and compares the signals to provide an output through the conductor 62 when the signals correspond.

Figure 8:
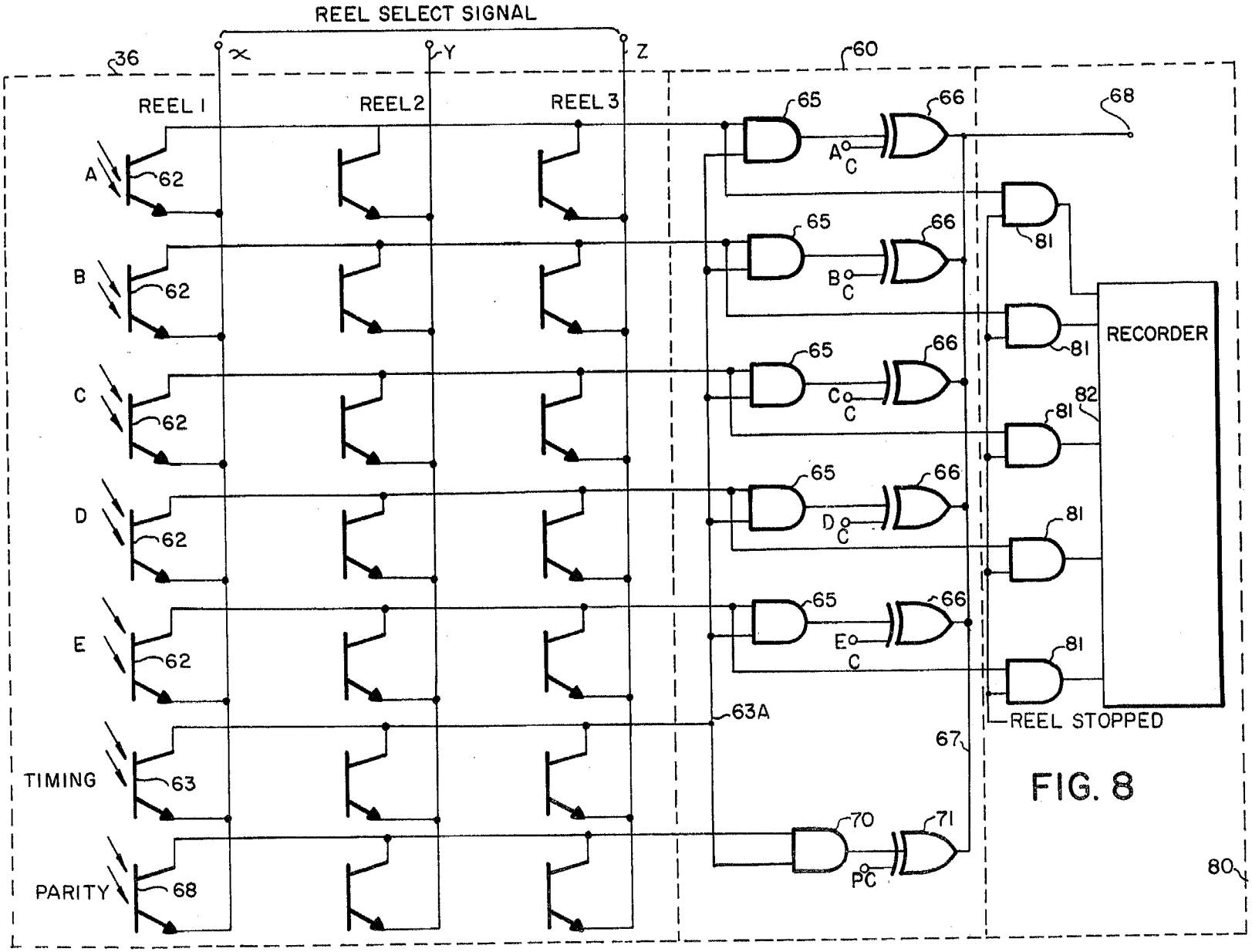
FIG. 8 is a circuit diagram of the reel motion and position detector.

A circuit diagram of the reel motion and position detector 36 is illustrated schematically in FIG. 8. Therein are shown three reel motion and position detectors 36, one for each reel 13 of the reel mechanism 17. Photo sensors 62 are each illustrated with the arrows indicating the light which passes through the openings in the reel flange 39. The emitters of the photo sensors are all tied together such that by applying the proper signal to one of the terminals X, Y or Z, the photo sensors of that array will be energized so as to detect light passing through the associated reel. Thus a signal is transmitted through each of the conductors 51 corresponding to whether or not an opening in the reel itself falls between the light source and the respective photo sensor. This signal is transmitted along with a timing signal from the photo sensor 63 through the conductor 63A to the comparator 60. This comparator comprises a series of AND gates 65 which receive at the other terminal the timing signal through the conductor 63A. Thus the AND gates can only conduct at the time the timing slot 58 is aligned with its associated photo sensor, assuring that the photo sensor array is in direct alignment with the address sector of the reel.

Thereafter a signal is transmitted through the AND gates 65 receiving both the timing and the photo sensor signal to an EXCLUSIVE/OR gate 66. At the other terminal of each gate 66 are supplied the signals from the random number generator 35 corresponding with the respective number which is generated. The signal is thus transmitted to the terminals $A_c$, $B_c$, $C_c$, $D_c$ and $E_c$ such that when the signals correspond, i.e. if no signal is received at either terminal, or a signal is received at both terminals, there is a correlation between the number on the reel and the number selected by the random number generator. Of course if any one of the EXCLUSIVE/OR outputs is at the lower level indicating different signals at the terminals thereof, no rise in the output signal will occur at the conductor 67.

When all signals received by the EXCLUSIVE/OR gate 66 correspond, the signal level on the conductor 67 changes indicating the comparator 60 has detected a correlation between the random number generator output and the reel position signaling that the reel should be stopped. Thereafter a stop signal output will be supplied at the terminal 68 which subsequently is transmitted through the conductor 62 to the reel stop mechanism 19.

Both the address and decode photo sensor arrays include parity to assure integrity of the data. However, to further insure that the correct decode (of symbol) is representing the actual player visual impression of the stopped reels the address uses ODD parity and the decode uses EVEN parity. That is, due to the indexing wheel design only a correctly positioned stopped reel—with a symbol over "win lines" will be accepted as DECODE data. These parity signals are indicated by the presence of a signal passing through the AND gate 70, the EXCLUSIVE/OR gate 71 to the conductor 67. Thus as can be seen, there is provided the schematic for one embodiment of the reel motion and position detector 36 and the comparator 60 which signals when the reel mechanism must be stopped to make the address correspond to that selected by the random number generator.

In accordance with another feature of the invention and as shown in FIG. 6, the trigger slots 44 are positioned to stop the reel with the photo sensor array always in alignment with the decode section 55 of the reel. Thus during the address readout the photo sensor array is used to detect the address codes on the reel by use of the timing signal supplied by the presence of the timing slot 58. However upon energization of the reel stop mechanism 19, the toggle bar 47 is driven into the aligned trigger slot 44 for stopping the reel. Because of the specific positioning of each of the trigger slots, the reels are always stopped with the photo sensor array adjacent the decode section of the reel, which decode section corresponds with the address section at which the reel was stopped in accordance with the random number generated. Thereafter the reel stop signal is fed to a reel position recorder 80 (FIG. 4) along with the signals from the conductors 51 corresponding to the photo sensor levels.

As shown in FIG. 8, a reel position recorder 80 receives the reel stop signal along with the photo sensor signals which are passed to a series of AND gates 81 and thereafter to a recorder 82. In this manner the specific signals corresponding to the decode code are recorded. The recorder can be of any usual type but preferably is a RAM (random access memory) of capacity sufficient for recording all of the decode signals from each of the individual reels.

The purpose for recording these signals is to permit checking of the reel position once all the reels are stopped to make sure the reel positions have not been tampered with. Without such recording and in prior devices, if access can be gained to the machine interior it is possible to alter the positions of the reels prior to triggering the payout logic thereby obtaining a higher payout than the original reel position requires. However in the embodiment shown, as each reel is stopped the decode signal is transmitted immediately through the conductor 84 (FIG. 5) both to the control and payout logic 24A and to the reel position recorder 80. After all reels are stopped and the control logic is signaled to initiate payout computations, a comparison is made between the reel stopped decode signals recorded in the reel position recorder 80 and the reel decode signals read immediately prior to the payout computation to ascertain that the reel mechanism has not been tampered with or otherwise moved.

Figure 5:
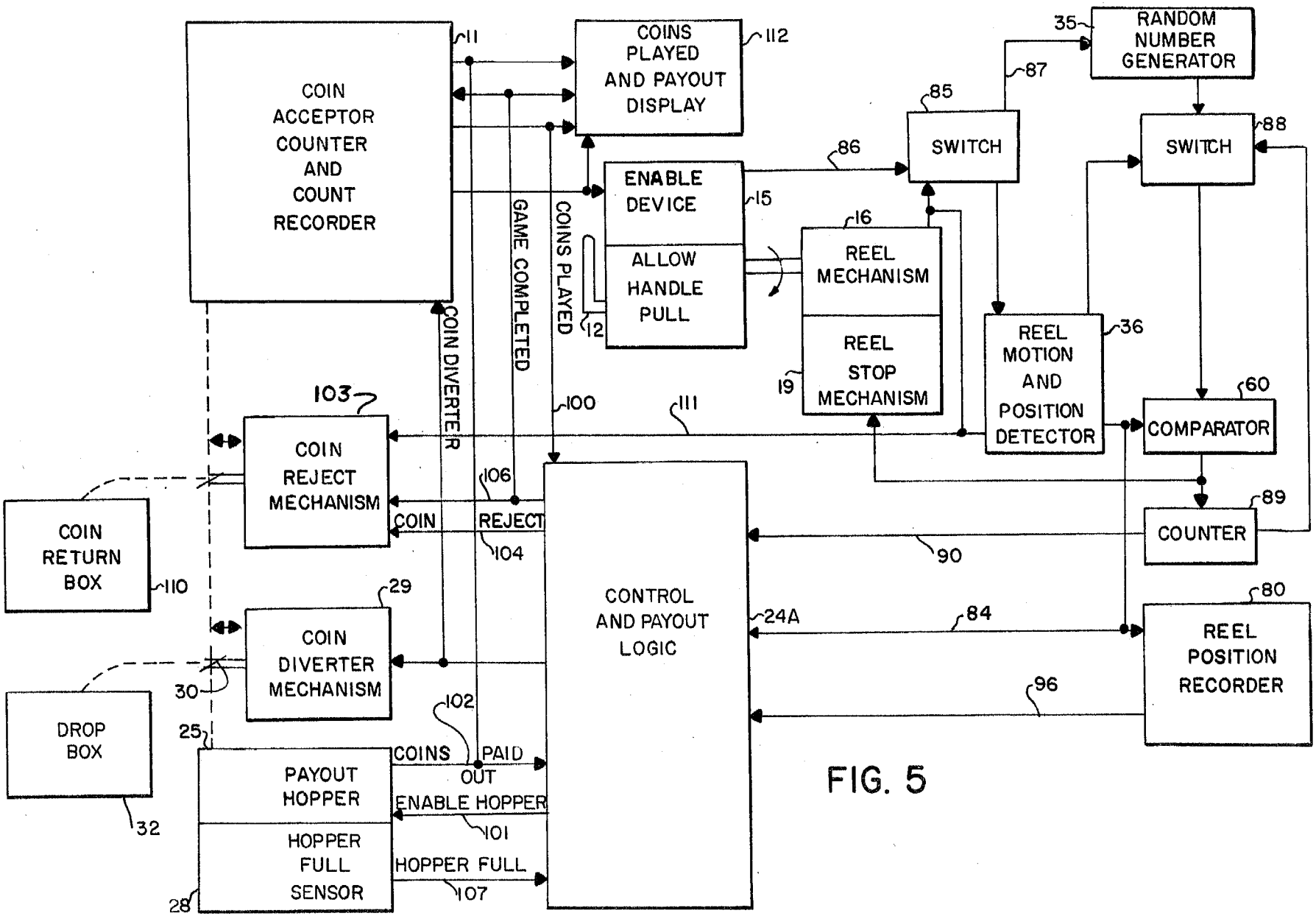
FIG. 5 is a block diagram showing a second embodiment of the invention.

Turning now to FIG. 5, there is shown a further embodiment of the invention. As in the past embodiments, there is provided a coin acceptor 11, an enabling device 15, a reel mechanism 16, a reel stop mechanism 19, a coin diverter mechanism 29, a payout hopper 25, a hopper full sensor 28, a drop box 32, a random number generator 35, a comparator 60 and a reel position recorder 80. Each of those components function in the same manner as in the embodiment of FIG. 4.

In addition, there is provided a switch 85 connected to receive through the conductor 86 the enabling signal from the enabling device 15 and a signal through conductor 111 from the reel mechanism indicating the reels have been set into rotation. Both of these signals can be supplied by the closing of switches in response to the energization of the enabling device as in present machines and a switch closed by the actuation of the handle 12 causing the rotation of the reels. With the receipt of these signals the reel position mechanism is energized to initiate reel position detection. Energization of the random number generator is also effected through the conductor 87.

With energization of the reel position detector, a signal is supplied to switch 88 permitting the transmission of a number from the random number generator to the comparator causing the initiation of a search for that number by the reel position detector. When a comparison is sensed, the reel stop mechanism is signaled to energize the solenoid 45 (FIG. 6) and stop the reel. The same signal serves to set a counter 89 at one count, which counter in turn causes the random number generator to close the switch 88 causing another number to be transmitted to the comparator.

The sequence is repeated for stopping the individual reels 13 of the reel mechanism until the counter reaches a predetermined count equal to the number of reels in the reel mechanism. Thereafter through the conductor 90 the control and payout logic are signaled to initiate the payout computation as in past embodiments. Thus the payout logic is signaled indicating the reel mechanism is now totally at rest, that is, all of the reels have been stopped.

Figure 9:
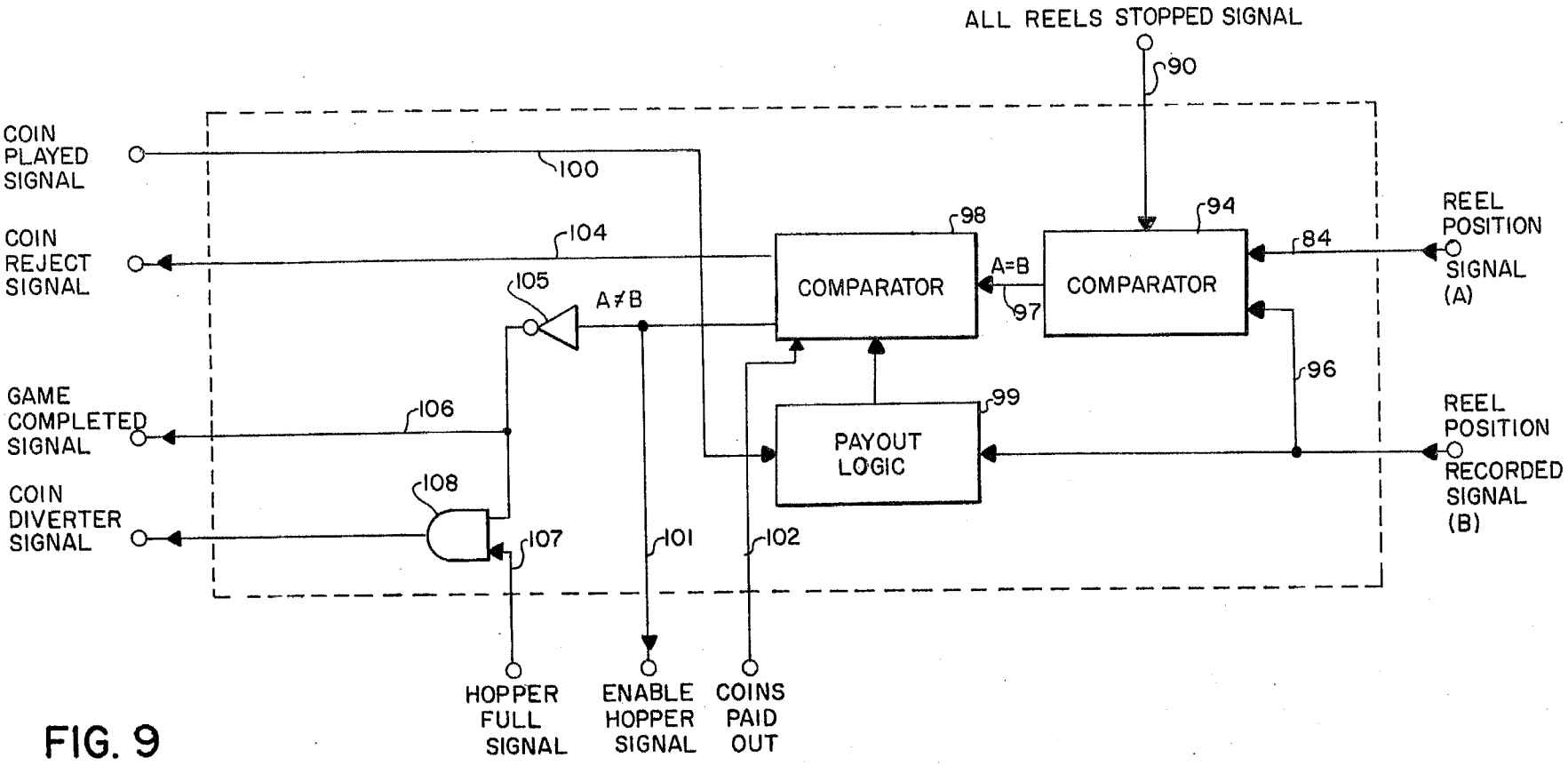
FIG. 9 is a block diagram of the control logic of the subject invention.

With all the reels at rest, the control and payout logic are energized to calculate any payout due the player because of the alignment of the indicia on the reels. The circuit diagram for the control is shown in FIG. 9. With the receipt of the all reel stopped signal from the counter 89, a comparator 94 is energized to receive a reel position signal through the conductor 84 and a reel position recorded signal through the conductor 96 from the reel position recorder 80. These signals are referred to as signal A and signal B and should compare. If they do, a signal is transmitted through the conductor 97 energizing the comparator 98. At the same time the payout logic 99 has already received a coins-played signal through the conductor 100 from the coin acceptor 11. Thus a payout signal calculated as a result of receiving the reel position recorded signal B through the conductor 96 is fed to the comparator 98 which causes the comparator to supply a hopper enable signal through the conductor 101. Thus the comparator 98 thereafter compares the payout logic signal with a coins paid out count signal received back from the payout hopper through the conductor 102 and so long as these signals do not compare, a hopper enable signal is supplied.

At the same time through the conductor 104 a coin reject signal is supplied to the coin reject mechanism 103 to prevent acceptance of any further coins. When the coins paid out signal equals the payout signal, the comparator 98 ceases the enable hopper signal. At this point there is supplied through an inverter 105 a game completed signal which is transmitted to the coin acceptor through conductor 106 enabling the coin acceptor to once again receive coins.

During this operating period there is received by the control a hopper condition signal through conductor 107 which changes levels when the hopper full sensor 28 senses that the hopper is in fact full. The sensor preferably senses the hopper weight and if the weight exceeds a predetermined value, signals that the hopper is full. The game completed signal is fed to an AND gate 108 along with the hopper full signal such that at the end of the game the coin diverter mechanism can be energized to divert the coins from falling into the payout hopper but instead be deflected to the coin drop box 32.

Thus in accordance with another feature of the invention, the coin diverter mechanism can only be energized at the end of a game thereby preventing any diversion of coins during the playing of a game or while coins are being paid in succession to start a game sequence. Thus by supplying the coin diverter signal only at the end of the game and by supplying this same coin diverter signal to the coin acceptor which includes a standard coin counter, the coin diverter is only signaled to change positions at the end of each game and not during the time period when additional coins are being offered to the gaming device. By controlling the coin flow in this manner, there is a positive indication as to which repository, i.e. the payout hopper 25 or the drop box 32, receives the coins and an accurate count and inventory can be maintained of the coins that are in each of those containers. By controlling the coin flow in this precise manner, a check can always be maintained as to whether or not the coins in the various repositories correspond to the coins played and thereby indicating none have been removed by persons having unauthorized access to the coin repositories. Also shown in this embodiment (FIG. 5) is a coin return box 110 which receives the coins when the coin reject mechanism is energized and returns the coins to the player. This same coin reject mechanism is also energized by the reel mechanism signal indicating the reel has been put into motion and the duplication of these signals is merely to assure that the player cannot continue to drop coins into the machine after play has started by actuation of the handle 12. The reel mechanism signal is supplied through the conductor 11.

Thus in accordance with another feature of the invention, there is displayed both the coins played and the coins paid out after each game. Accordingly there is supplied to a coins played and payout display 112 signals indicating the coins played, the coins paid out and the game completed signal as well as the receipt by the coin acceptor of sufficient coins to energize the enabling device 15. This display continues until the initialization of the subsequent game wherein the display is reset. Such displays are well-known and provide a visual indication that the player has received the required payout. This display will continue so long as the winning combination continues on the stopped reels to enable confirmation that a proper payout was completed in accordance with the combination of indicia on the reel mechanism.

Thus as can be seen, the circuit of FIG. 5 provides a step-by-step assurance that the sequence of play is correct. For instance the reel mechanism must turn before the random number generator is caused to supply a number. Subsequent to this number generation, the counter must count out prior to the control and the payout logic being energized. At the same time the coin reject mechanism is energized to prevent the insertion of further coins. Thereafter, the payout hopper is energized and the visual indication is displayed of coins paid out in accordance with the stopped reel mechanism position. Following payout, the machine signals whether coins received during the next play shall be deposited in the payout hopper or in the drop box and the coin counter is signaled so as to properly credit the coin count to the correct repository. During this period there remains displayed the coins played and the payout resulting from the last game. In addition, unless the reel stopped position corresponds with the recorded reel stopped position, no payout will occur.

The invention claimed is:

1. A game apparatus of the type having a set of cyclically rotational movable symbol-bearing members which are activated and set into motion by a player to be subsequently stopped with the alignment of the symbols on the members serving as a determination of the score-award for the game played, comprising in combination:

means activated by the player for setting the symbol-bearing members into motion;

each of the symbol-bearing members having adapted for rotation therewith coding means for defining a predetermined number of possible symbol stopping positions and comprising alternate address and decode information elements for each of said symbols, the address and decode information for each symbol being unique to that symbol;

means for reading the address information elements for said symbols as the symbol-bearing members pass a predetermined point in their respective rotational cycles and for detecting the instantaneous position of the symbol-bearing members;

a generator for generating on a random basis numbers corresponding to the address information elements for the various stopping positions of the symbol-bearing members;

means for selecting a number from the generator and for stopping each symbol-bearing member at the position corresponding to the address information elements for the random number selected;

means for reading the decode information elements for each symbol-bearing member after each member is stopped to detect the stopped position of each member and for determining the relative positions of said members;

means for determining the score-award for the game played based on the relative stopped positions of said symbol-bearing members.

2. A game apparatus as defined in claim 1 wherein the means for selecting a number selects said number for one movable member and stops said movable member at the position corresponding to the number and thereafter sequentially selects numbers and stops each movable member in sequential order.

3. A game apparatus as defined in claim 2 wherein said means for detecting the position of the movable members comprises elements in sectors on each movable member in combination with means for sensing said elements and signaling the member position.

4. A game apparatus as defined in claim 3 wherein said means for detecting the instantaneous position of the movable members comprises groups of openings at each sector of said movable member with the relative positioning of the openings varying to indicate the various positions of the movable members, in combination with light-emitting means and a light detector positioned on opposite sides of the movable member with the light detector generating signals responsive to the positions of the openings in the sector of the movable member aligned between the light-emitting means and the light detector.

5. A game apparatus as defined in claim 4 wherein said movable member sectors each include openings indicating the position of the movable member and openings indicating a code corresponding to the symbol on the movable member corresponding to said position.

6. A game apparatus as defined in claim 5 wherein said means for detecting the position of said movable member detects the openings indicating the position of said movable member during the stopping of the movable member in response to the random number received, and thereafter detects the openings indicating the code corresponding to the symbol for detecting the stopped position of the movable member for determining the score-award for the game.

7. A game apparatus as defined in claim 1 wherein said movable members comprise a set of reels and said means for selecting said random numbers selects a first number and stops a first reel at a position corresponding to that number and thereafter sequentially selects numbers and stops a corresponding reel until all of the reels are brought to an at-rest position.

8. A game apparatus as defined in claim 7 including means for recording the code corresponding to the at-rest position of each reel as the reel is stopped.

9. A game apparatus as defined in claim 8 wherein said means for determining the score-award of the game compares the code of the reels in the stopped position and the recorded code for the reels in the at-rest position and makes such score-award determination only if said codes correspond.

10. A game apparatus as defined in claim 1 wherein said alternate address and decode information elements for each of said symbols comprise a plurality of light transmitting means disposed in alternating sectors of the movable members and having different patterns for each symbol stopping position, said apparatus further comprising a light emitter positioned to emit light onto the light transmitting means and light detecting means for sensing the light from the light transmitting means and signaling the pattern of light to thereby indicate the sector of the movable member from which the light is transmitted, the symbol stopping position of said member and the stopped symbol for score-award determination.

* * * * *

UNITED STATES PATENT AND TRADEMARK OFFICE

CERTIFICATE OF CORRECTION

PATENT NO. : 4,238,127

DATED : December 9, 1980

INVENTOR(S) : Lucero et al.

It is certified that error appears in the above—identified patent and that said Letters Patent is hereby corrected as shown below:

Column 8, line 33, "11" should be --111--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*